United States Patent [19]

Pietryka et al.

[11] 4,382,462

[45] May 10, 1983

[54] UNIT IN A CONTINUOUS CASTING INSTALLATION FOR POSITIONING A DUMMY BAR

[75] Inventors: Joseph Pietryka, Paris; Joël Cazaux, Chelles; André Guyot, La Neuville Thumeries, all of France

[73] Assignee: Fives-Cail Babcock, Paris, France

[21] Appl. No.: 207,409

[22] Filed: Nov. 17, 1980

Related U.S. Application Data

[63] Continuation of Ser. No. 44,632, Jun. 1, 1979, abandoned.

[30] Foreign Application Priority Data

Jun. 14, 1978 [FR] France ..... 78 17725

[51] Int. Cl.[3] ..... B22D 11/08

[52] U.S. Cl. ..... 164/426

[58] Field of Search ..... 164/425, 426, 445, 446

[56] References Cited

U.S. PATENT DOCUMENTS 3,661,199 5/1972 Bollig ..... 164/426

FOREIGN PATENT DOCUMENTS 2073236 10/1973 France .

47-37815 9/1972 Japan ..... 164/426

48-4302 2/1973 Japan ..... 164/426

51-17942 6/1976 Japan ..... 164/426

*Primary Examiner*—Gus T. Hampilos

*Attorney, Agent, or Firm*—Kurt Kelman

[57] ABSTRACT

The invention is an apparatus for removing a dummy bar from a casting line and reintroducing the dummy bar into the mold. The apparatus comprises a handling system for moving a basket from an end station where the dummy bar is separated from a continuous casting to a position above the mold of the casting installation. The system includes a lifting frame capable of holding the basket, a raising device having one end attached to the lifting frame for vertically raising the lifting frame, a travel frame supporting and end of a raising device opposite to the one end, the travel frame having vertical runways capable of receiving and guiding the raised lifting frame, and a horizontal pathway supporting the travel frame for movement to and from the position above the mold.

14 Claims, 11 Drawing Figures

UNIT IN A CONTINUOUS CASTING INSTALLATION FOR POSITIONING A DUMMY BAR

This application is a continuation, of application Ser. No. 44,632, filed June 1, 1979, now abandoned.

This invention concerns a unit for the positioning of a dummy bar in the preparation of a new casting operation, in a continuous casting machine.

French patent publication No. 2,073,236 discloses a unit of this type, consisting of a basket in which the dummy bar, separated from the casting line, is lodged, a handling system to bring the basket into position above the mould, and means by which the dummy bar is introduced into the mould.

In accordance with this patent, at the end of a casting operation, after the mould has been cleaned and prepared for a new cast, the basket containing the dummy bar is moved into position above the mould by an overhead travelling crane, and is then placed vertically on the upper edge of the mould frame.

This arrangement has certain drawbacks. There are no means of guiding the basket while it is being moved by the overhead travelling crane, which is all the more disadvantageous when the weight of the basket and the dummy bar is substantial. Furthermore, the basket being moved into a vertical position above the mould, means by which the dummy bar is inserted into the latter must be provided at a considerable height above the casting floor, which calls for considerable space requirements.

The main object of this invention is to avoid the aforementioned drawbacks.

More precisely, the invention is concerned with a unit of the type mentioned above and which comprises a handling system for moving the basket from an end station wherein the dummy bar is separated from the continuous casting to a position above the mould of the casting installation. The system includes a lifting frame capable of holding the basket, a raising means having one end attached to the lifting frame for vertically raising the lifting frame, a travel frame supporting an end of the raising means opposite to the one end, the travel frame having vertical runway means capable of receiving and guiding the raised lifting frame, and a horizontal pathway supporting the travel frame for movement to and from the position above the mould.

The lifting frame is movable along a vertical runway.

This runway includes, on each side of the basket, an upright of the same cross-section as travel frame uprights defining the vertical runway means so that these uprights may be moved into registry.

The lifting frame consists of two uprights connected at their tops by a cross-piece. These uprights, which are of the same height as the travel frame uprights, are fitted with rollers running along the uprights which form the runway.

The lifting frame contains, on each of its sides, a lifting shackle integral with the travel frame.

The raising means, includes two winches placed respective sides of the frame, the winches being driven by the same motor.

The means of controlling the movement of the travel frame along its horizontal path are constituted by rollers which run along the path, two rollers on respective sides of the path being driving rollers.

In one embodiment of the invention, the basket is mounted pivotally on the lifting frame, and the travel frame uprights make up a support for the rotation of the basket.

It is advantageous for the basket to contain a sprocket wheel at the dummy bar delivery end. The teeth of this wheel engage the links of the chain constituting the dummy bar and the basket extends over a quarter of a circle around the sprocket wheel.

The lifting frame supports a motor which can control the 180° pivoting of the basket.

In a second embodiment of the invention, the basket is constituted by a circular casing which surrounds a coaxial sprocket wheel, the teeth of which engage the links of the chain that forms the dummy bar through the inner wall of that casing. The casing extends over an arc of a circle of 270° and has straight end cross-section which are perpendicular to each other, one being horizontal, the other vertical.

Whichever method is used to construct the basket, two successive teeth on the sprocket wheel are separated by a large space. The position of these teeth with respect to the first tooth the dummy bar comes into contact with on its introduction into the basket, and the size of the space, are calculated in such a way that the front of the dummy bar can engage the sprocket wheel.

The rotation of the sprocket wheel is controlled by a motor which is integral with the basket, by means of a clutch.

It is advantageous for the basket to be mounted on the lifting frame so that it can slide sideways.

The invention is easier to understand when referring to the following description in conjunction with the annexed drawings and which shows two presently preferred embodiments of this invention.

Figure 1:
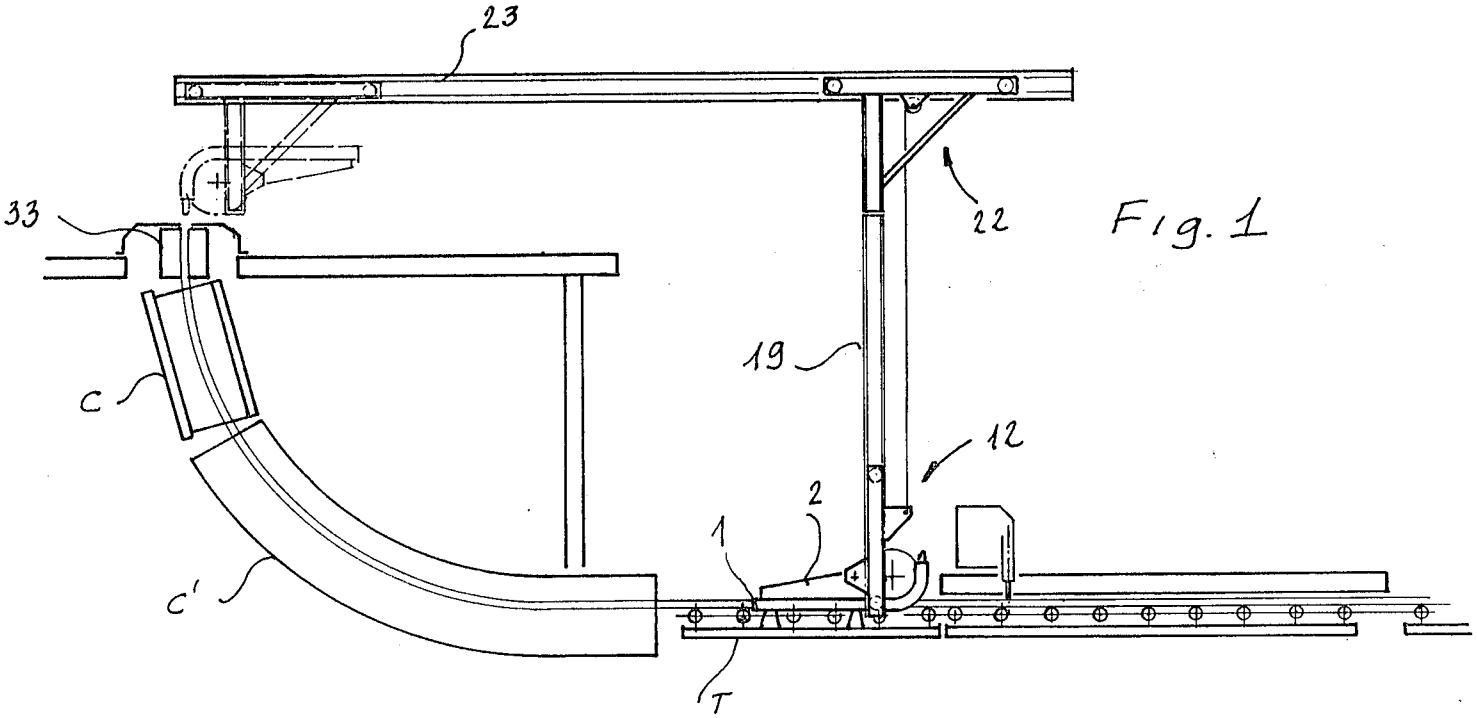
FIG. 1 is a general view of a continuous casting installation equipped with the unit in accordance with the invention.
Figure 2:
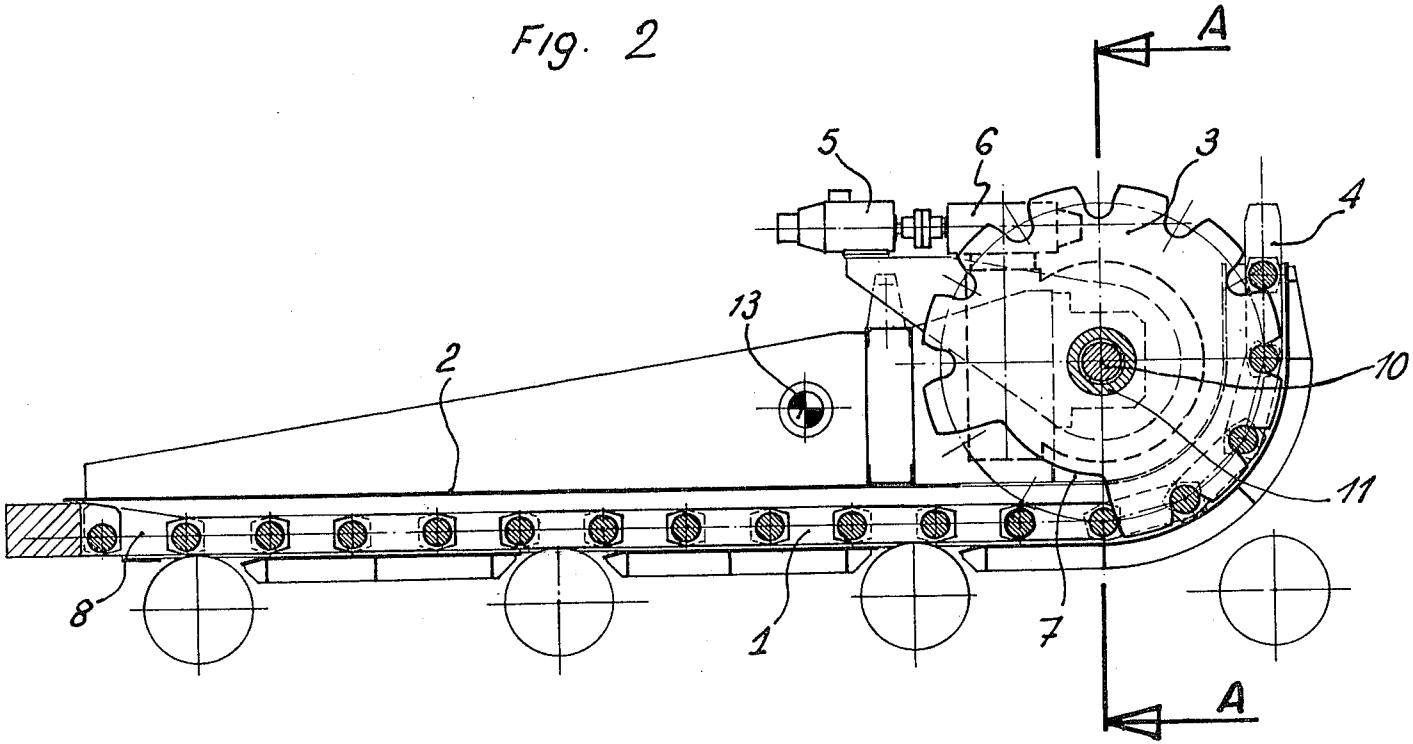
FIG. 2 is a side elevational view along line B—B of FIG. 3, showing the basket containing the dummy bar at the moment of its separation from the casting line.
Figure 3:
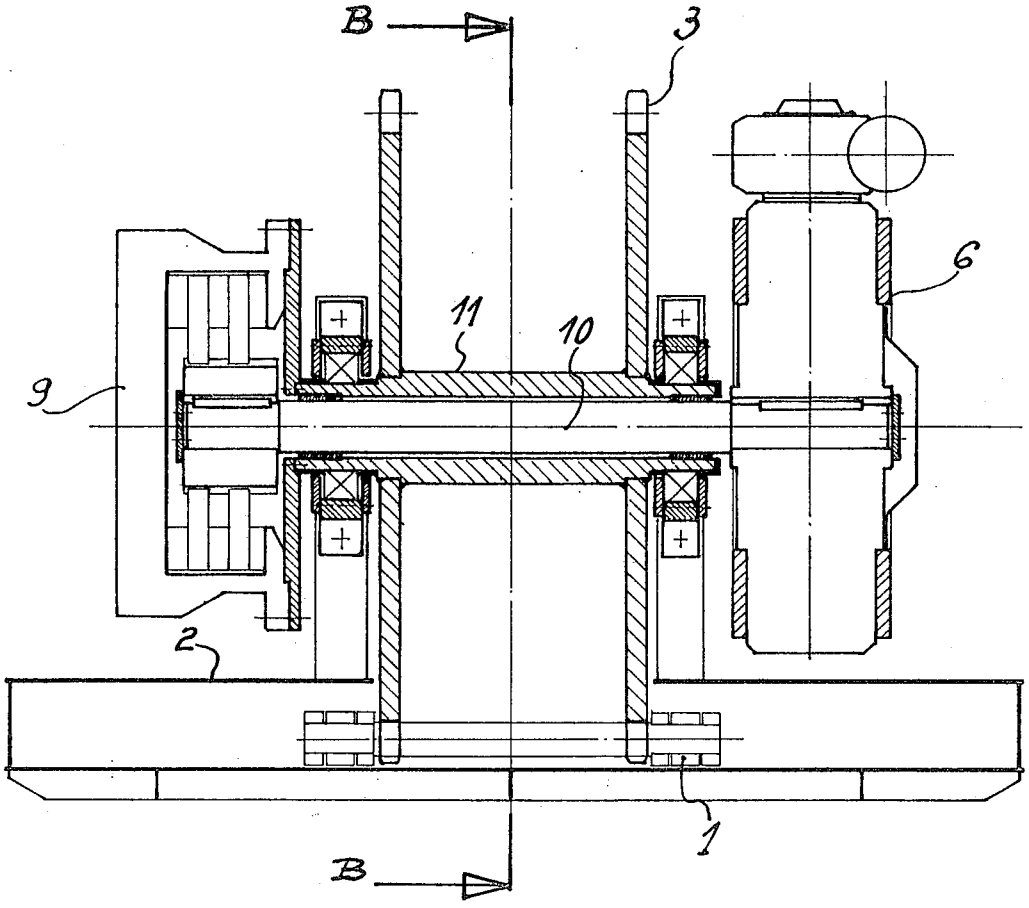
FIG. 3 is a cross-sectional view along line A—A of FIG. 2.
Figure 4:
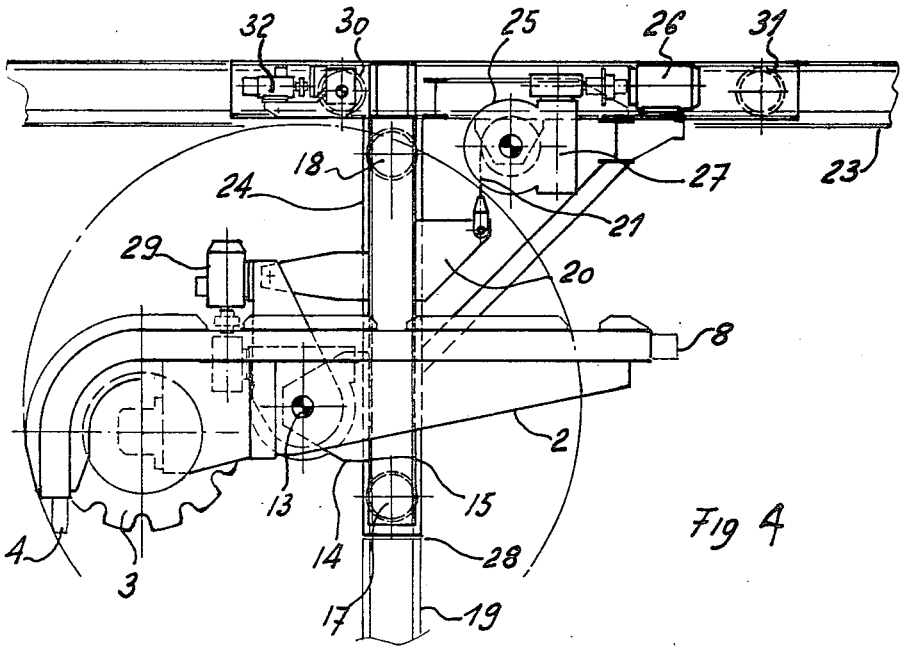
FIG. 4 is a front view of the whole unit, showing the basket in its reversed position, its lifting frame being lodged in the travel frame's vertical runways.
Figure 5:
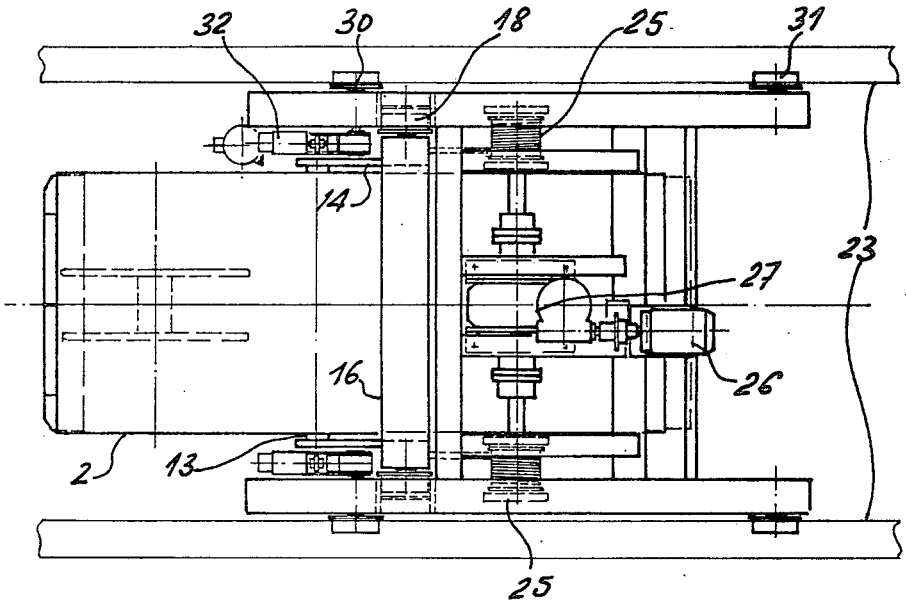
FIG. 5 is a top view of the unit as shown in FIG. 4.
Figure 7:
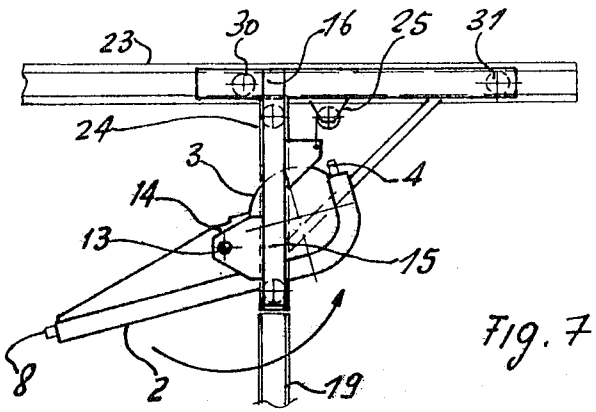
Figure 8:
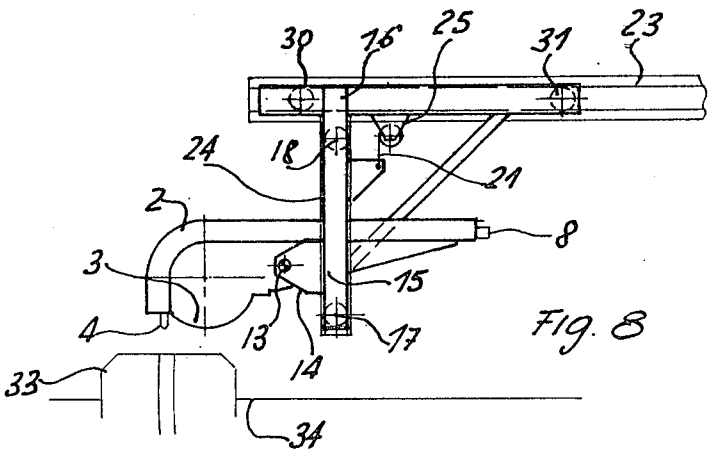
Figure 6:
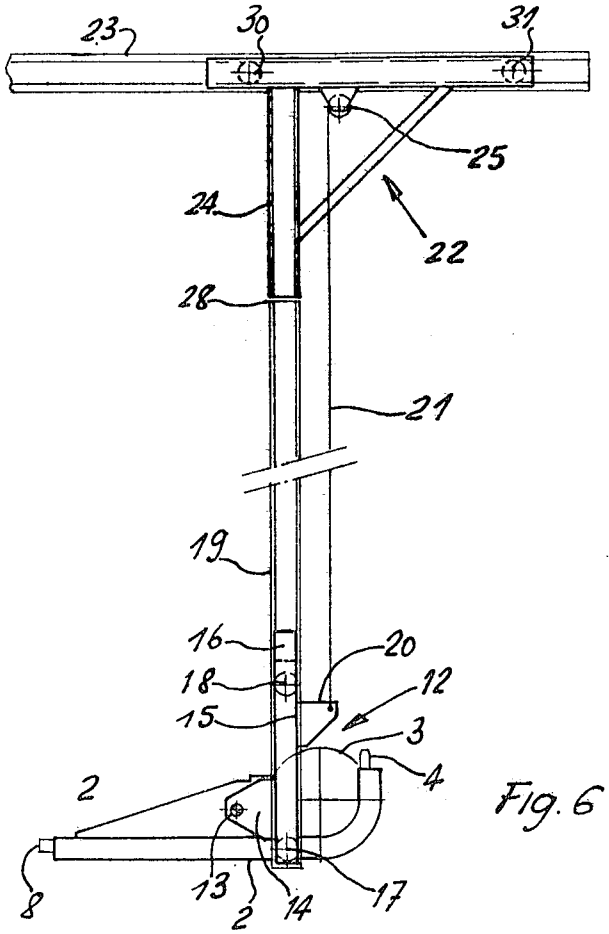
Figure 9:
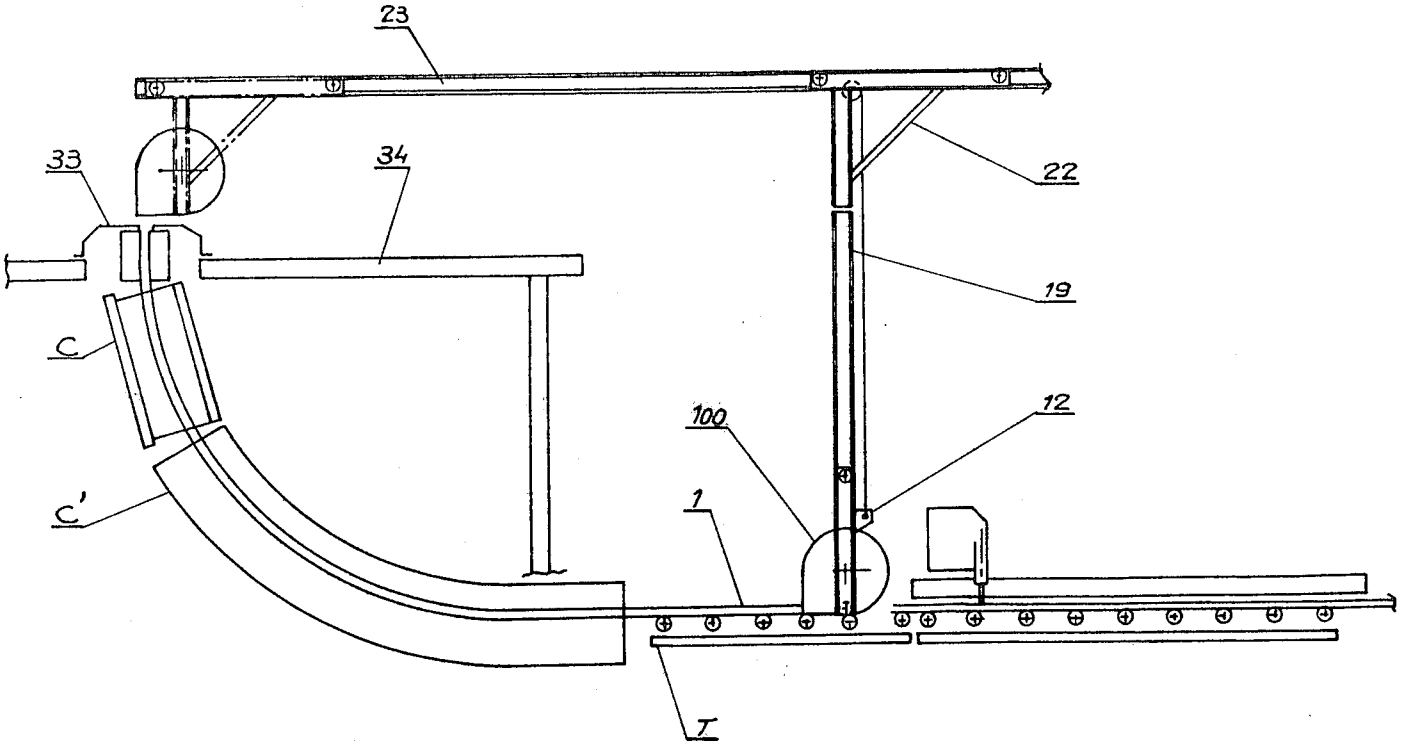
Figure 10:
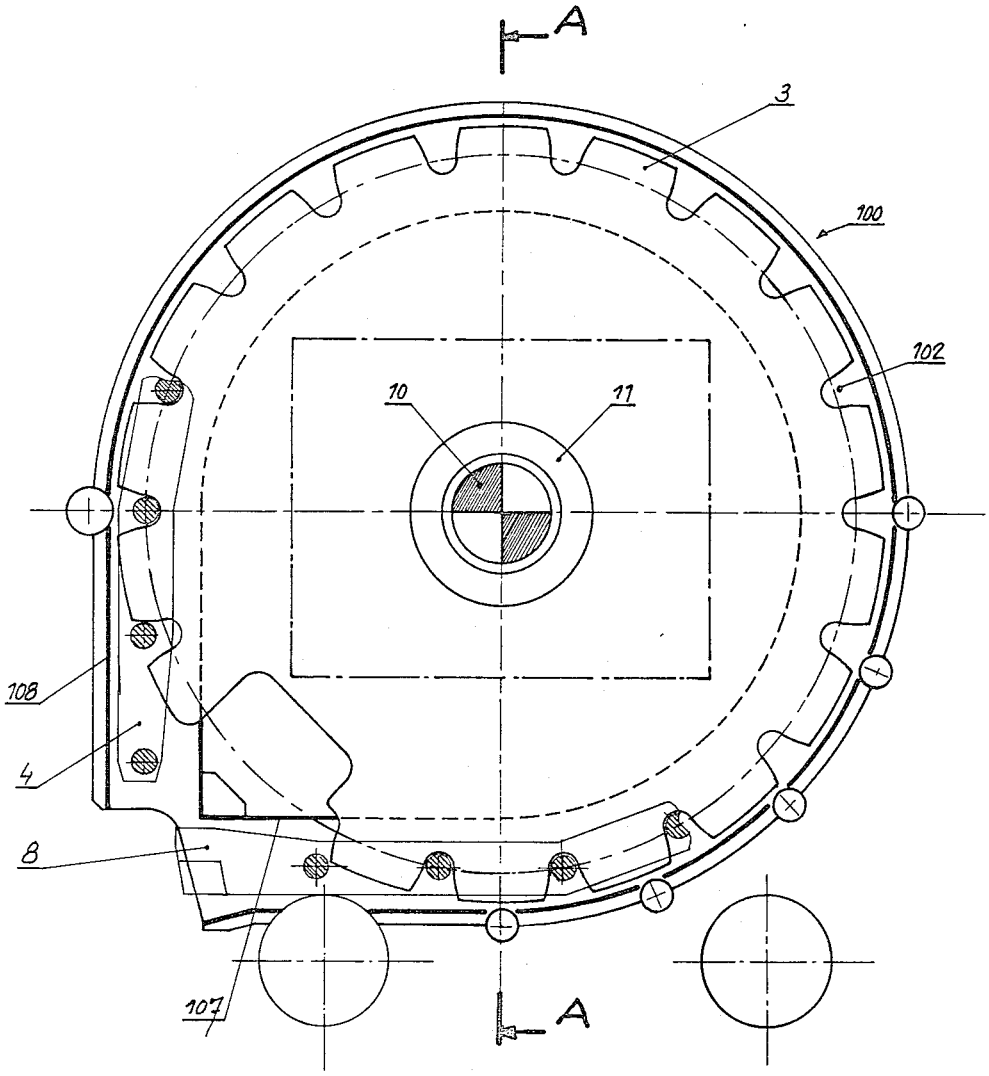
Figure 11:
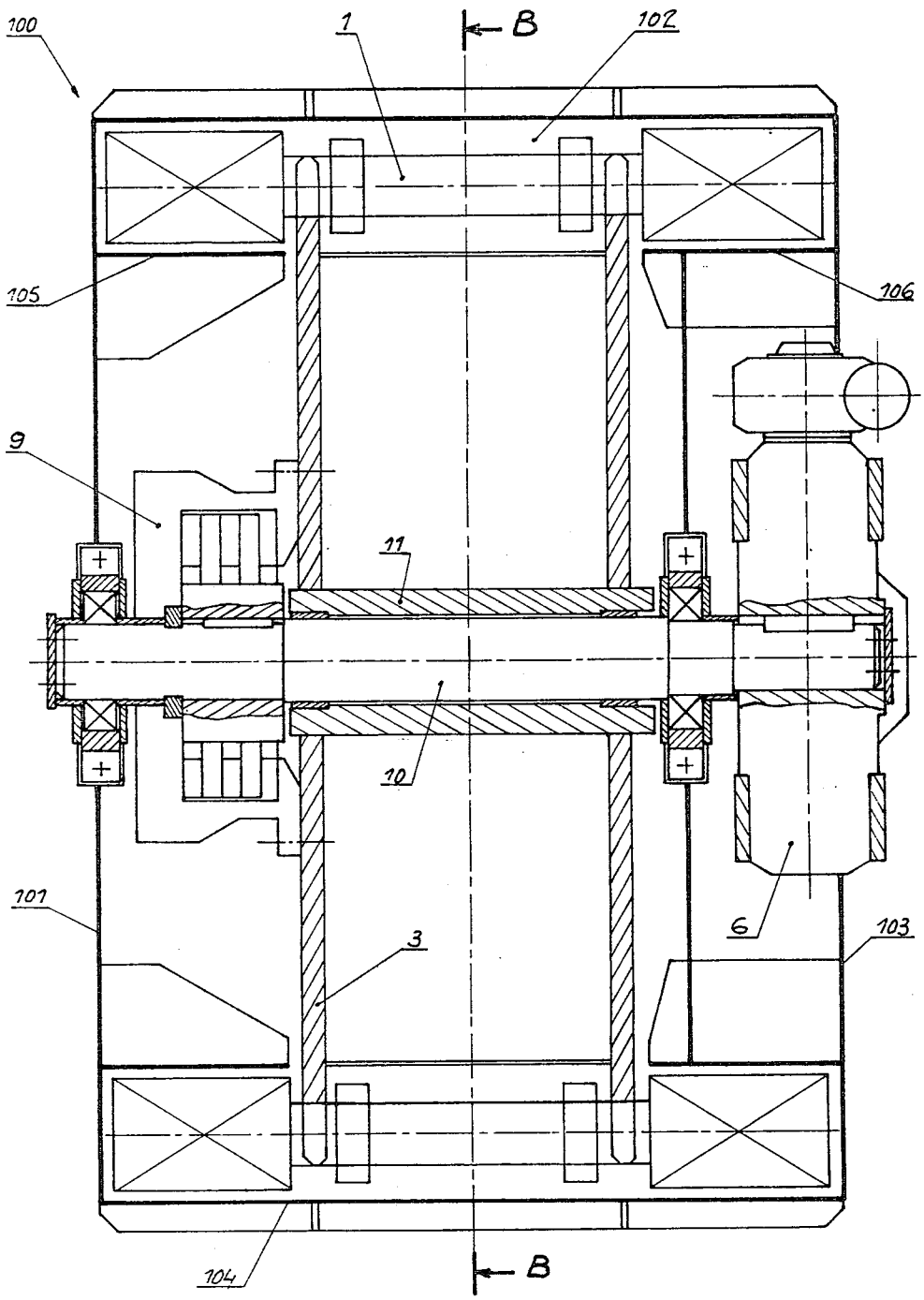

FIGS. 6, 7 and 8 schematically illustrate the main stages in the handling of the basket;

FIGS. 9, 10 and 11 are views which are respectively analogous to those of FIGS. 1, 2 and 3 illustrating an alternative embodiment.

FIG. 1 schematically illustrates a curved continuous casting machine equipped with the unit in accordance with the invention and including mould 33 at the outlet of which the cast product, a slab for example, is guided by a conventional roller apron consisting of an upper part C and a lower part C'. The dummy bar 1 for the starting of the cast is shown here inside a basket 2 which rests on the roller table T of an ingot discharge conveyor, this conveyor being placed at the apron outlet C–C'. It is from this position that the dummy bar 1 is separated at the casting, using a well-known method, and transported into its basket 2, as will be explained later on. The position of the basket 2, at the moment of the introduction of the dummy bar 1 into the mould 33 is shown in dotted lines. Various parts 12, 19, 22 and 23 of the basket handling system are described in more detail with reference to FIGS. 4 to 8.

In FIGS. 2 and 3, the dummy bar 1 is shown lodged inside its basket as represented in FIG. 1. This basket includes, at its outlet end, a sprocket wheel 3, the teeth of which engage the links of the chain constituting the dummy bar 1. This dummy bar enters the basket 2 through the inlet delivery end of the basket, opposite the end which is fitted with the sprocket wheel 3. When the tail end 4 of the dummy bar 1 comes into contact with one of the teeth on the sprocket wheel 3, the latter is rotated by a motor 5 through speed reducer 6. The driving by the motor 5 is stopped as soon as the first link of the chain has been engaged by the tooth on the sprocket wheel 3 which follows the tooth initially engaged.

The start-up and stopping of the motor 5 are automatically controlled by an appropriate device. The dummy bar 1 moves along by itself until the tail end 4 reaches the vertical position shown in FIG. 2. It will be noticed that there is a large space 7 between two successive teeth on the sprocket wheel 3. The position of these teeth with respect to the first tooth engaged and the size of the space between them are calculated in such a way that the head 8 of the dummy bar 1 can engage the sprocket wheel at a subsequent stage of operation. This will be described in more detail later on. In the position shown in FIG. 2, the head 8 which is separated from the casting line is situated in the inlet end of the basket 2. It is from this position that the basket 2 is raised by the lifting means described hereinafter. In FIG. 3, clutch 9 is shown mounted on output shaft 10 of speed reducer 6 which imparts the rotation movement of the motor 5 to the sprocket wheel 3 by means of a shaft 11, concentric with shaft 10, and upon which the sprocket wheel 3 is mounted. A system of electrical contacts (not shown) controls the rotation of the sprocket wheel 3 in such a way that the sprocket wheel can at will be driven by the motor 5.

FIGS. 4 to 8 show a lifting frame 12 for basket 2 upon which the said basket is mounted in such a way that it pivots about a horizontal shaft 13 supporting on the bearings 14 which are integral with the lifting frame 12. The latter basically consists of two vertical uprights 15 having a U shaped cross-section, these uprights being arranged on each side of the basket 2 and connected at their upper parts by a cross-piece 16. Each upright 15 of the lifting frame 12 is fitted with rollers 17 and 18 which allow it to run along a vertical runway which is formed by an upright 19 with a U-shaped cross-section. The two uprights 19, arranged on each side of the frame, are fixed to the ground by their bases. Furthermore, each upright 15 is fitted with a shackle 20 to which is attached a lifting cable 21 under the action of which the frame 12 is raised, the rollers 17 and 18 of its upright 15 running along the vertical runway formed by upright 19.

Travel frame 22 can run along a horizontal path 23 from which the frame hangs. The frame 22 has, on each of its sides, upright 24 which is strictly identical to the corresponding upright 19 and forms a corresponding vertical runway. Upright 24 is initially in contact with upright 19, as can be seen clearly in FIG. 6. The frame 22 also includes lifting means which are constituted by two winches 25, arranged on each side of the frame and both driven by the same motor 26, through a speed reducer 27. Each cable 21 is wound around a winch 25 in such a way that the raising of the frame 12 is ensured. While the frame is moving on its upward travel, its upright 15 engage the vertical runway of upright 24. When the frame 12 reaches the end of its upward travel, the uprights 15 have left the runway formed by uprights 19 and are completely lodged in the runways of uprights 24, the length of these runways corresponding exactly to that of the uprights 15. A small gap 28 is provided between the uprights 19 and 24.

When the frame 12 occupies the position which has just been described, frame 22, or more precisely its uprights 24 constitute for it a support for the tilting of the basket 2 which, during its upward travel with the frame 12, has remained in a horizontal position, as shown in FIG. 2. The 180° tilting of the basket takes place about the shaft 13 and is controlled by a motor 29 which is integral with the frame 12. The reversed basket 2 occupies the position shown in FIG. 4, the tail-end 4 of the dummy bar 1 pointing towards the bottom. Thus it is possible to move the frame 22 along its horizontal path 23 which is formed by parallel girders along which the rollers 30 and 31 run, these rollers being provided on each side of the frame 22. The rollers 30 are driving rollers controlled by motors 32. The travel of the frame 22, which drives along frame 12, is stopped as soon as the basket 2 is above the mould 33, the tail-end 4 of the dummy bar 1 then being in a position ready to go into the mould, as shown in FIG. 8. At this moment, the motor 5 makes the sprocket wheel 3 rotate in such a way that the dummy bar 1 descends into the mould 33 until its tail end 4 engages the drive rollers of the apron C—C′ which drive the dummy bar 1 until its head 8 blocks the bottom of the mould 33. The passage of by head 8 around the sprocket wheel 3 is ensured the space 7 provided between two teeth on the sprocket wheel 3, as previously indicated. Reference number 34 shows the casting floor above which the horizontal path 23 of the frame 22 is arranged.

It will be noticed that the difference in height between the casting floor 34 and the path 23 is relatively small. This results from the fact that, as opposed to the arrangement described in the French Pat. No. 2 073 236, the basket 2 occupies a horizontal and not a vertical position above the mould 33.

FIGS. 6, 7 and 8, which have already been referred to, illustrate the three main stages in the handling of the basket 2. In FIG. 6, the basket 2 is in the departure position as the moment of the separation of the dummy bar 1 from the casting line. It is important that the upright 19 be placed firmy in contact with uprights 24. This is obtained by immobilising the frame 22 in a suitable position along its path 23. Stops (not shown) could be used advantageously to restrict the travel of the frame 22 to the right, beyond the said position. In FIG. 7, the basket 2 is shown being tilted about the shaft 13 in the direction indicated by the arrow. Uprights 24 and 19 are still in contact. Contrary to this arrangement, it would be possible to carry out the tilting of the basket 2 after the frame 22 has been moved to the left, for example midway between the position shown in FIG. 7 and that in FIG. 8. The tilting of the basket 2 could thus be carried out above a storage area accessible to an operator with the job of removing the head 8 from a section of cast ingot attached to the head, or of replacing the dummy bar with another dummy bar taken from the storeroom. In FIG. 8, the basket 2 is shown in the arrival position above the mould 33. Stops, which are not shown, could also be provided in order to prevent the frame 22 from going beyond this position during its travel to the left along the path 23.

When the dummy bar 1 is in the starting position, its head 8 blocking the bottom of the mould 33, it is possible to proceed to a new casting operation. To begin with, the basket 2 has to be placed in its initial position. The handling of the basket 2 which has been emptied of the dummy bar 1 is carried out by reversing the sequence of operations which have just been described. To this end, the frame 22 is moved until its uprights 24 come into contact with the uprights 19. The basket 2 is then tipped over so as to restore it to the position from which is received the dummy bar, and then the frame 12, the uprights 15 of which come out of the runways of uprights 24 to engage the runways of uprights 19. The return operation is completed when the frame 12 is back in the position shown in FIG. 6. A new casting operation can thus begin.

FIGS. 9 to 11 show an alternative in accordance with which the basket is designed in such a way that it can be mounted on the lifting frame, thus avoiding any tipping of the basket.

In these figures, the same reference numbers as those in the previous figures have been used to show the identical elements. Only the elements which are specific to this alternative and the elements which have been clearly modified shall be described hereinafter.

Reference number 100 shows the whole of a basket borded by two vertical side walls 101 and 103, and by an intermediate wall 104. The outline of the latter has the shape of an arc of a circle extending over 270°, each end of the arc of a circle being extended tangentially.

The basket 100 includes a casing 102 fitted around the outline of the wall 104. The outer wall of the casing 102 is constituted by the wall 104. The inner wall of the casing 102 is formed by the two wall elements 105 and 106, which are respectively integral with walls 101 and 103. These two wall elements, located opposite each other, run parallel with the wall 104 over the whole of its outline. The casing 102 is borded at each side by walls 101 and 103, or more precisely by the parts of these walls included between the wall elements 105 and 106 and wall 104.

The casing 102 thus described extends over an arc of a circle of 270° and has straight end sections 107 and 108 which are perpendicular to each other. Section 107, arranged horizontally, constitutes the inlet section of the dummy bar 1, while section 108, arranged vertically, constitutes the outlet section of the dummy bar.

The casing 102 surrounds a sprocket wheel 3 which is coaxial with respect to the casing. The teeth of this sprocket wheel engage the links of the chain which constitutes dummy bar 1 lodged in the casing 102, through the inner wall of the casing, more precisely through the passage provided between the two wall elements 105 and 106.

The basket 100 is mounted on the lifting frame 12 so that it cannot pivot. However, it can slide sideways so as to correctly position the inlet section 107 with respect to the dummy bar 1. The latter arrangement is also applicable for the mounting on the lifting frame 12 of the basket 2 shown in FIGS. 1 to 8.

When, at the moment of introduction of the dummy bar 1 into the casing 102, the tail-end 4 of the said dummy bar comes into contact with the first pre-set tooth of the sprocket wheel 3, the latter is driven in rotation until the dummy bar 1 reaches the storage position shown in FIG. 10. During this motion the tail-end 4 rotates 180° in an upward direction, then 90° in a downward direction, and finally goes down along the outlet section 108 in a straight line.

The basket 100 can thus be moved by means of a handling system, which has already been described, so as to bring the section 108 into line with the cavity of mould 33. Thus the rotation of the sprocket wheel 3 controls the descent of the dummy bar 1. It is clear that the reversal of the basket in order to bring the tail-end 4 of the dummy bar 1 into position above the cavity of mould 33 is avoided, due to the fact that the dummy bar 1 comes out of the casing 102 in a downward direction.

The sprocket wheel 3 can be rotated in the opposite direction to the previous rotations, when the basket 100 is stopped above the casting floor 34. Thus the head 8 of dummy bar 1 can be extracted in order to replace it or possibly remove a section of the ingot attached to the head.

The structure of the sprocket wheel 3 and its means of control are the same as those in the embodiment shown in FIGS. 1 to 8.

Although the invention has been described with reference to a particular embodiment, it is, of course, not limited to it and modifications may be made without departing from the invention. In particular, any one of the embodiments described could be replaced by a technically equivalent embodiment. The invention in fact covers not only the illustrated embodiments but also various alternative methods of construction.

We claim:

1. A unit in a continuous casting installation for positioning a dummy bar in preparation of a casting operation, the casting installation comprising a mold for producing a continuous casting attached to the dummy bar and an end station wherein the dummy bar is separated from the continuous casting, and the unit comprising a basket capable of receiving the separated dummy bar, a handling system for moving the basket from the end station to a position above the mold, the system including a lifting frame capable of holding the basket, a raising means having one end attached to the lifting frame for vertically raising the lifting frame, a travel frame supporting an end of the raising means opposite to one end, the travel frame having two vertical uprights capable of receiving and guiding the raised lifting frame, a horizontal pathway supporting the travel frame for movement to and from the position above the mold, two fixed uprights mounted on respective sides of the basket at the end station for vertically displacing the lifting frame towards the uprights of the travel frame, the fixed uprights and the uprights of the travel frame being of the same cross section and the uprights of the travel frame being capable of being moved into registry with the fixed uprights by a displacement of the travel frame along the horizontal pathway, and means for introducing the dummy bar from the basket into the mold from above.

2. The unit of claim 1, wherein the lifting frame includes two uprights having upper ends and a crosspiece connecting the upper ends of the uprights of the lifting frame, the length of the lifting frame uprights being the same as that of the uprights of the travel frame, and the uprights of the lifting frame having rollers enabling the lifting frame to move along the fixed uprights and the uprights of the travel frame.

3. The unit of claim 1, wherein the raising means includes a lifting shackle at each side of the lifting frame.

4. The unit of claim 3, wherein the raising means includes a winch at each side of the travel frame and a motor driving both winches.

5. The unit of claim 1, wherein the travel frame has rollers guided along the horizontal pathway, two of the rollers mounted at respective sides of the pathway being driving rollers.

6. The unit of claim 1, wherein the basket is a circular casing having an axis and an interior wall, and further comprising a sprocket wheel mounted coaxially in the casing and having circumferentially spaced teeth projecting through a slot in the interior casing wall, the dummy bar being constituted by a link chain and the sprocket wheel teeth engaging the links of the chain constituting the dummy bar.

7. The unit of claim 6, wherein the circular casing extends an arc of a circle of 270° and terminates in two tangentially extending end portions which are perpendicular to each other, one end portion extending horizontally and the other end portion extending vertically.

8. The unit of claim 1, wherein the dummy bar is constituted by a link chain and further comprising a sprocket wheel mounted in the basket and having circumferentially spaced teeth engaging the links of the chain constituting the dummy bar.

9. The unit of claim 8, wherein a substantially circumferential gap extends between two of said sprocket wheel teeth, the two teeth being so positioned relative to a first sprocket wheel tooth engaged by a respective one of the chain links upon introduction of one end of the dummy bar into the basket and the length of the gap being such that the other end of the dummy bar is engaged by the sprocket wheel.

10. The unit of claim 8, further comprising a motor mounted in the basket for driving the sprocket wheel and a clutch arranged between the motor and the sprocket wheel.

11. The unit of claim 1, wherein the basket is arranged in the lifting frame for lateral movement in relation thereto.

12. A unit in a continuous casting installation for positioning a dummy bar in preparation of a casting operation, the casting installation comprising a mold for producing a continuous casting attached to the dummy bar and an end station wherein the dummy bar is separated from the continuous casting, and the unit comprising a basket capable of receiving the separated dummy bar, a handling system for moving the basket from the end station to a position above the mold, the system including a lifting frame capable of holding the basket, the basket being mounted on the lifting frame for pivoting, a raising means having one end attached to the lifting frame for vertically raising the lifting frame, a travel frame supporting an end of the raising means opposite to the one end, the travel frame having vertical runway means capable of receiving and guiding the raised lifting frame, the vertical runway means being arranged for supporting the pivoting of the basket, a horizontal pathway supporting the travel frame for movement to and from the position above the mold, and means for introducing the dummy bar from the basket into the mold from above.

13. The unit of claim 12, wherein the basket has a delivery end for delivering the dummy bar received therein, and a sprocket wheel mounted at the delivery end of the basket, the dummy bar being constituted by a link chain and the sprocket wheel having circumferentially spaced teeth engaging the links of the chain constituting the dummy bar, the basket extending over a quarter of a circle around the sprocket wheel.

14. The unit of claim 13, further comprising a motor mounted on the lifting frame for controlling the pivoting of the basket, the basket being arranged for pivoting over an angle of 180°.

* * * * *